US006050854A

United States Patent [19]

Fang et al.

[11] Patent Number: 6,050,854

[45] Date of Patent: Apr. 18, 2000

[54] AUDIO CONNECTOR

[75] Inventors: Ming-Kung Fang, Pao-Chiao; Yao-Hao Chang, Chung-Ho, both of Taiwan

[73] Assignee: Hon Hai Precision Ind. Co., Ltd., Taipei Hsien, Taiwan

[21] Appl. No.: 09/121,237

[22] Filed: Jul. 23, 1998

[30] Foreign Application Priority Data

Sep. 17, 1997 [TW] Taiwan ..... 86215940

[51] Int. Cl.[7] ..... H01R 13/648

[52] U.S. Cl. ..... 439/607; 439/609; 439/668

[58] Field of Search ..... 439/607, 668, 439/931, 744, 669, 63, 55, 108, 83, 609, 939, 188

[56] References Cited

U.S. PATENT DOCUMENTS 5,092,795 3/1992 Kitagava ..... 439/668
5,288,248 2/1994 Chen ..... 439/609

*Primary Examiner*—Paula Bradley
*Assistant Examiner*—Alexander Gilman

[57] ABSTRACT

An audio connector comprises an insulative housing having a plug extending therefrom and defining a hole through a portion thereof adjacent to the plug, a U-shaped plate made of metal having a curved tab extending therefrom, and a metal shielding having an elastic tab beside which two slits are defined for providing deformation space for the elastic tab. The U-shaped plate is received in the housing from the hole thereof and the metal shielding is adapted to enclose the housing with the elastic tab thereof abutting against the curved tab of the U-shaped plate.

13 Claims, 6 Drawing Sheets

AUDIO CONNECTOR

BACKGROUND OF THE INVENTION

1. Field of the Invention

The present invention relates to an audio connector, and particularly to an audio connector which includes a shielding for preventing noise.

2. Prior Art

An audio connector (also called audio jack) is usually installed on a printed circuit board (PCB) which is fixed in a personal computer and a mating portion of the audio connector is exposed to exterior of the personal computer. A conventional audio connector 9 shown in FIGS. 5 and 6 comprises an insulative housing 91 from which a plurality of signal contacts 92 and a grounding contact 93 extend. A plug 911 defining a reception hole 912 extends from a mating portion of the housing 91. A shielding 94 is adapted to enclose the plug 911. Two holes 913 are respectively defined in opposite surfaces of the housing 91 adjacent to the plug 911 for receiving the grounding contact 93 and allowing a soldering portion 931 thereof to extend through one of the holes 913 for soldering to a PCB (not shown). The signal contacts 92 each have a portion received in the housing 91 and a soldering portion 921 extending out of the horsing 91 for soldering to the PCB. The shielding 94 has a collar 941 from which two tabs 942, 943 extend for compressive engagement with the grounding contact 93 via the holes 913 for suppressing electromagnetic interference (EMI) from affecting in the connector 9. However, since the engagement position between the grounding contact 93 and the shielding 94 lies within the outer periphery of the housing 9, the physical contact therebetween is unstable. Therefore, EMI may considerably affect signal transmission due to an intermittent contact therebetween. Moreover, attaching the shielding 94 onto the housing 91 is laborious since extra jigs are required to bend the tabs 942, 943 twice for facilitating a forcible engagement with the grounding contact 93.

SUMMARY OF THE INVENTION

The primary purpose of the present invention is to provide an audio connector which can effectively suppress EMI from affecting the function thereof.

A second purpose of the present invention is to provide an audio connector having a shielding which can be attached to a housing thereof without requiring extra jigs or tools.

A third purpose of the present invention is to provide an audio connector which has elastic tabs extending therefrom for abutting against a metal enclosure of a personal computer for significantly eliminating noise from affecting the connector.

In accordance with one aspect of the present invention, an audio connector comprises an insulative housing having a plug extending therefrom and defining a hole through a portion thereof adjacent to the plug, a U-shaped plate made of metal having a curved tab extending therefrom, and a metal shielding having an elastic tab beside which two slits are defined for allowing deformation space for the elastic tab. The U-shaped plate is received in the housing through the hole and the metal shielding is adapted to enclose the housing with the elastic tab abutting against the curved tab of the U-shaped plate.

In accordance with another aspect of the present invention, an audio connector comprises an insulative housing having a plug extending therefrom and defining a hole through a portion thereof adjacent to the plug, a grounding device made of metal having a curved tab extending therefrom, and a metal shielding having a first elastic tab and a second elastic tab extending therefrom. The U-shaped plate is received in the housing from the hole and the metal shielding is adapted to enclose the housing with the first elastic tab abutting against the curved tab of the U-shaped plate and the second elastic tab abutting against an external metal enclosure of a personal computer.

These and additional object, features and advantages of the present invention will become apparent after reading the following detailed description of the preferred embodiment of the invention taken in conjunction with the appended drawing figures.

DETAILED DESCRIPTION OF THE PREFERRED EMBODIMENTS

Figure 1:
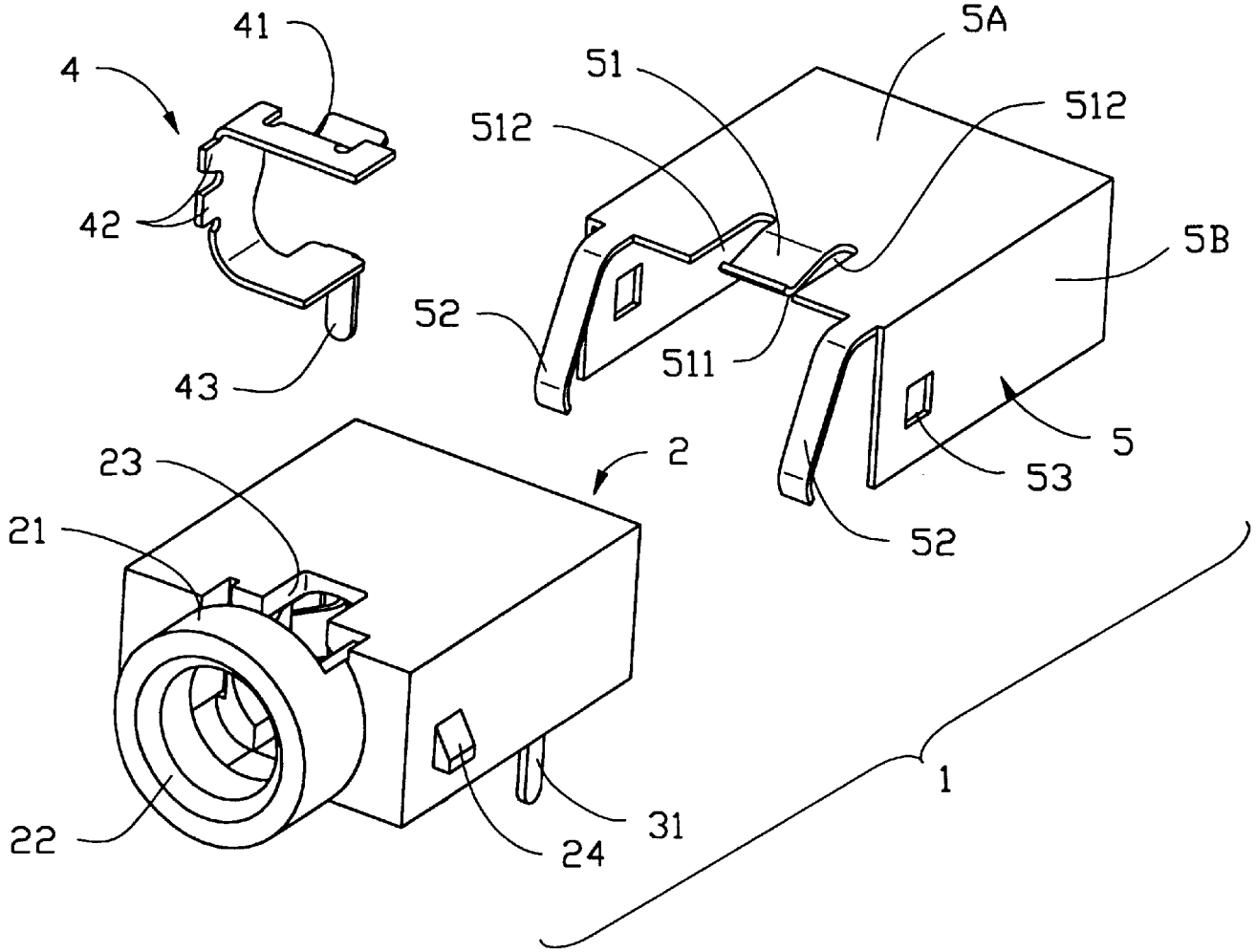
FIG. 1 is an exploded view of an audio connector in accordance with the present invention.
Figure 2:
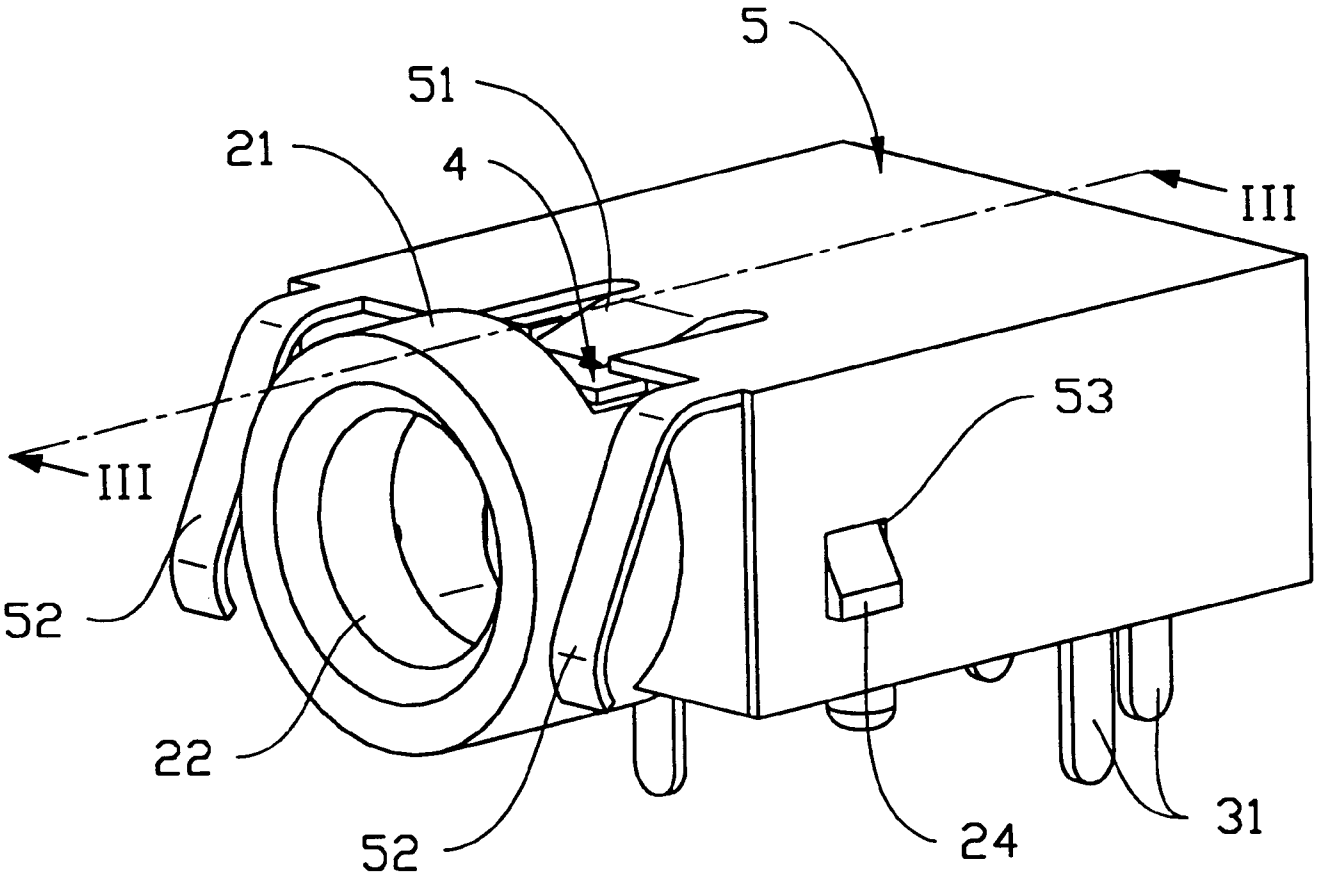
FIG. 2 is an assembled view of FIG. 1.
Figure 3:
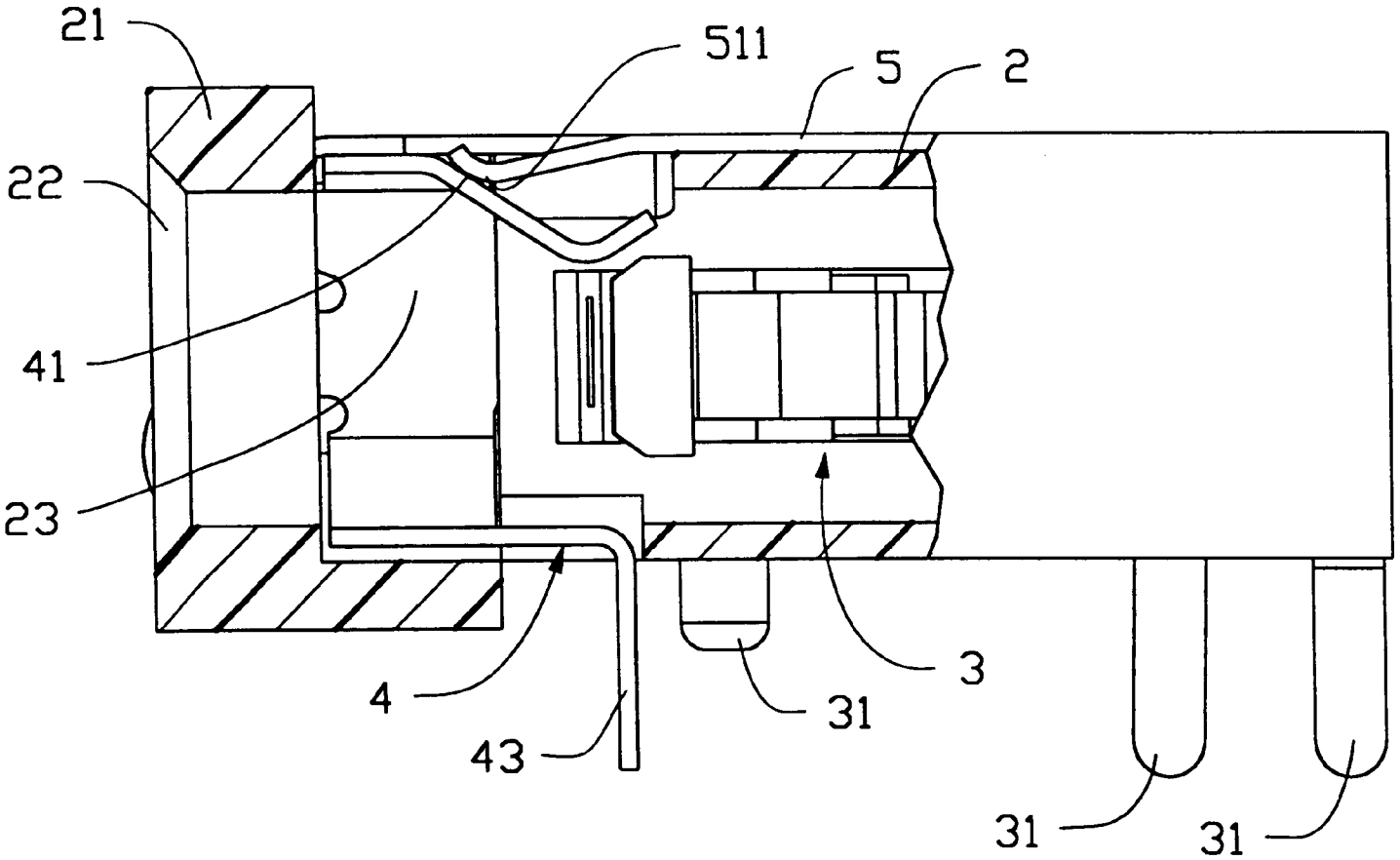
FIG. 3 is cross-sectional view taken from lines III—III of FIG. 2.

Referring to FIGS. 1, 2 and 3, an audio connector 1 in accordance with the present invention comprises an insulative housing 2, a plurality of contacts 3 received in the housing 2 and having soldering legs 31 extending beyond the housing 2 for connection with a PCB (into shown), a grounding device 4, and a shielding 5. The insulative housing 2 is substantially rectangular shaped, and has a collar-shaped plug 21 defining a mating hole 22 extending from one end thereof and two protrusions 24 extending from opposite sides thereof. The mating hole 22 receives a complementary connector (not shown). A hole 23 is defined through the housing 2 substantially adjacent to the plug 21 for receiving a portion of the grounding device 4. The grounding device 4 is substantially a U-shaped plate made of metal having a curved tab 41 extending laterally and downwardly from the U-shaped plate, an interference portion 42 extending away from the curved tab 41, and a soldering portion 43 extending downward for soldering on a grounding portion of the PCB (not shown). The curved tab 41 is adapted to be positioned in the housing 2 from the hole 23, with the interference portion 42 being interferentially engaged within a mating portion of the housing 2 (not shown).

The shielding 5 is substantially a U-shaped plate made of metal having an intermediate plate 5A and two side plates 5B bent downward from two sides of the intermediate plate 5A. The intermediate plate 5A has an elastic tab 51 diagonally extending from a central portion of a side thereof whereby two slits 512 are defined on either side thereof for providing sufficient deformation space for the elastic tab 51. Two grounding tabs 52 extend downward from the intermediate plate 5A on opposite sides of the elastic tab 51. The elastic tab 51 has a curved end 511 for facilitating engagement with the curved tab 41 of the grounding device 4 upon assembly of the shielding 5, the grounding device 4, and the housing 2 as shown in FIG. 3. The side plates 5B each define a reception hole 53 for engaging with the corresponding protrusion 24 of the housing 2 when the shielding 5 is fixed to the housing 2.

Figure 4:
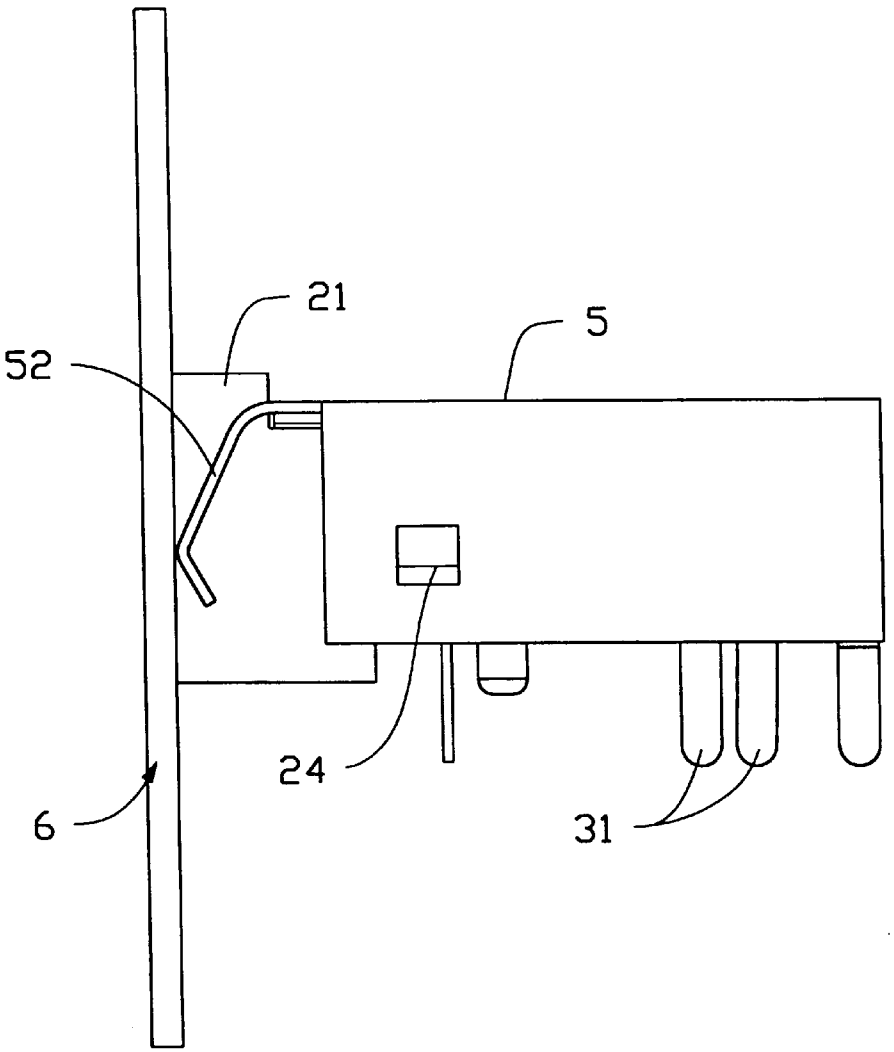
FIG. 4 is a side view of the audio connector abutting against a metal enclosure.
Figure 5:
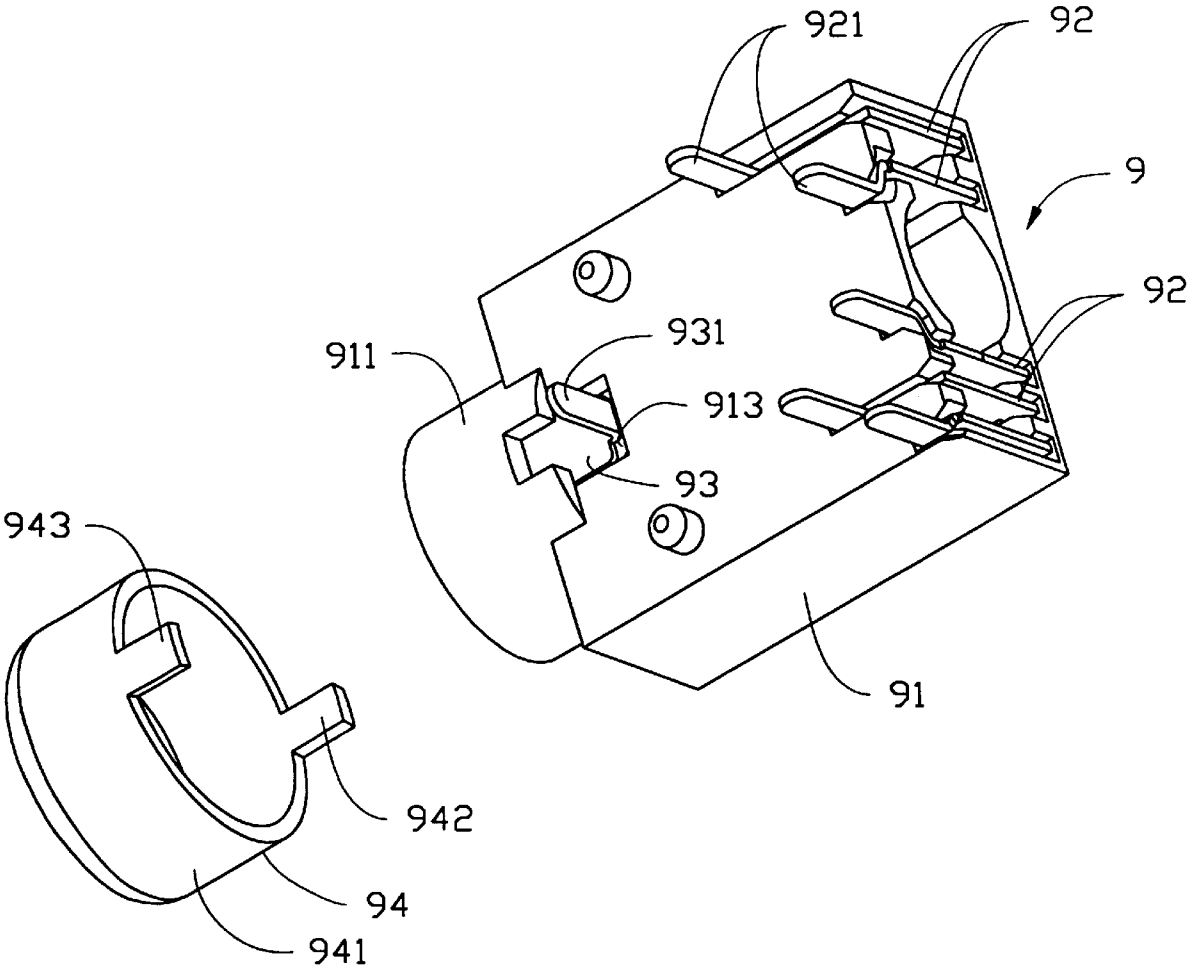
FIG.5 (PRIOR ART)
FIG. 5 is a bottom perspective view of a conventional audio connector.
Figure 6:
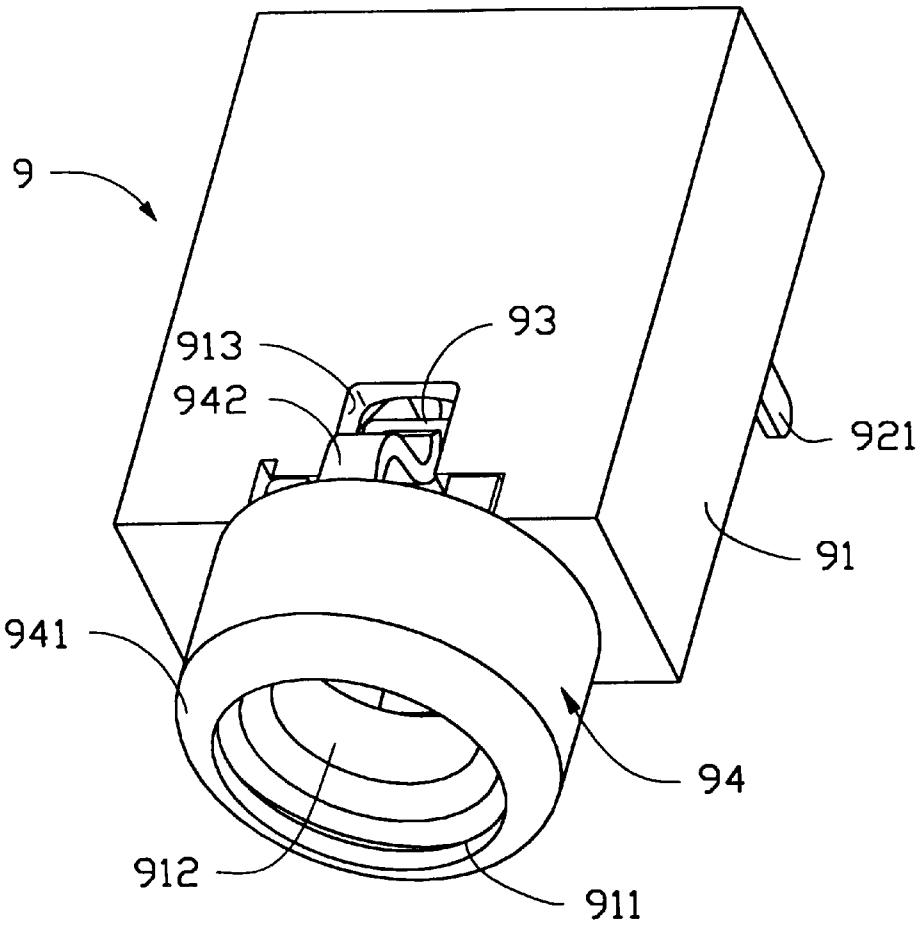
FIG.6 (PRIOR ART)
FIG. 6 is a top perspective view of FIG. 5.

Referring to FIG. 4, the grounding tabs 52 abut against a metal enclosure 6 (only a portion is shown) after the connector is installed in a personal computer (not shown) for promptly directing noise to the metal enclosure 6. With the above structure, the grounding device 4, the shielding 5, the grounding portion of the PCB (not shown) and the enclosure of the personal computer are electrically connected together thus EMI can be considerably eliminated.

While the present invention has been described with reference to a specific embodiment, the description is illustrative of the invention and is not to be construed as limiting the invention.

Therefore, various modifications to the present invention can be made to the preferred embodiment by those skilled in the art without departing from the spirit and scope of the invention as defined by the appended claims.

What is claimed is:

1. An audio connector comprising an insulative housing having a plug extending therefrom and defining a hole through a portion thereof adjacent to the plug, a U-shaped plate made of metal having a curved tab extending therefrom, and a metal shielding having an elastic tab beside which two slits are defined for providing deformation space for the elastic tab, whereby the U-shaped plate is received in the housing from the hole thereof and the metal shielding is adapted to enclose the housing with the elastic tab thereof abutting against the curved tab of the U-shaped plate.

2. The audio connector as claimed in claim 1, wherein the shielding has at least one elastic grounding tab extending therefrom for abutting against an external metal enclosure of a personal computer for providing a guiding path for noise.

3. The audio connector as claimed in claim 1, wherein the U-shaped plate has a soldering portion soldered on a grounding portion of an external printed circuit board.

4. The audio connector as claimed in claim 1, wherein the elastic tab has a curved end for abutting against the curved tab of the U-shaped plate.

5. The audio connector as claimed in claim 4, wherein the housing has at least one protrusion projecting from a wall thereof and the shielding defines at least a corresponding hole for engaging with the at least one protrusion of the housing.

6. An audio connector comprising an insulative housing having a plug extending therefrom and defining a hole through a portion thereof adjacent to the plug, a grounding device made of metal having a curved tab extending therefrom, and a metal shielding having a first elastic tab and a second elastic tab extending therefrom, whereby the grounding device is received in the housing from the hole thereof and the metal shielding is adapted to enclose the housing with the first elastic tab thereof abutting against the curved tab of the grounding device and the second elastic tab thereof abutting against an external metal enclosure of a personal computer.

7. The audio connector as claimed in claim 6, wherein the grounding device is substantially a U-shaped plate.

8. The audio connector as claimed in claim 7, wherein the first elastic tab of the shielding has a curved end for abutting against the curved tab of the grounding device.

9. The audio connector as claimed in claim 8, wherein the housing has at least one protrusion projecting from a wall thereof and the shielding defines at least a corresponding hole for engaging with the at least one protrusion of the housing.

10. The audio connector as claimed in claim 9, wherein the grounding device has a soldering portion soldered on a grounding portion of an external printed circuit board.

11. An audio connector comprising an insulative housing with a rectangular body and a collar-shaped plug extending forward therefrom, a grounding device positioned within a front portion of the housing, said grounding device including a curved tab, a metal shielding attached to and enclosing the rectangular body of the housing, and said metal shielding including an elastic tab extending thereof so as to abut against the curved tab of the grounding device.

12. The audio connector as claimed in claim 11, wherein the shielding further includes grounding tabs for engagement with an enclosure of a computer.

13. An audio connector comprising an insulative housing with a rectangular body and a collar-shaped plug extending forward therefrom, a grounding device positioned within a front portion of the housing, said grounding device including a curved tab a metal shielding attached to and enclosing the rectangular body of the housing, and said metal shielding including an elastic tab thereof so as to abut against the curved tab of the grounding device, wherein the curved tab generally extends rearward and the elastic tab generally extends forward, and said curved tab and said elastic tab can be compliantly engaged with each other.

* * * * *